United States Patent [19]

Gühne et al.

[11] Patent Number: 5,040,263

[45] Date of Patent: Aug. 20, 1991

[54] CARRYING BELT ARRANGEMENT FOR A VACUUM CLEANER

[75] Inventors: Wieland Gühne, Remscheid; Werner Dargel, Velbert both of Fed. Rep. of Germany

[73] Assignee: Vorwerk & Co. Interholding GmbH, Wuppertal, Fed. Rep. of Germany

[21] Appl. No.: 600,726

[22] Filed: Oct. 22, 1990

[30] Foreign Application Priority Data

Oct. 20, 1989 [DE] Fed. Rep. of Germany ..... 3934917

[51] Int. Cl.[5] ..... A47L 5/36; A47L 9/00

[52] U.S. Cl. ..... 15/327.5; 15/323; 15/329

[58] Field of Search ..... 15/323, 327.5, 329

[56] References Cited

U.S. PATENT DOCUMENTS 3,599,273 8/1971 Shivaganagi ..... 15/327.5 X
4,570,286 2/1986 Ross ..... 15/327.5 X

FOREIGN PATENT DOCUMENTS 8224611 12/1982 Fed. Rep. of Germany .
1000945 8/1965 United Kingdom ..... 15/327.5

*Primary Examiner*—Chris K. Moore
*Attorney, Agent, or Firm*—Walter Ottesen

[57] ABSTRACT

The invention relates to a carrying belt arrangement for a vacuum cleaner. The carrying belt is integrated directly into a hand grip at the end of the vacuum cleaner hose. The carrying belt arrangement of the invention defines a storage compartment in which the carrying belt is wound while at the same time defining a hand grip. The carrying belt arrangement includes first and second parts of which the first part is stationary. The second part is rotatably mounted on the first part and includes the drum on which the carrying belt is wound. The first part includes a cover which extends over the drum and includes a slot through which the carrying belt passes. The drum and cover conjointly define the storage compartment for the carrying belt.

6 Claims, 3 Drawing Sheets

Fig.1
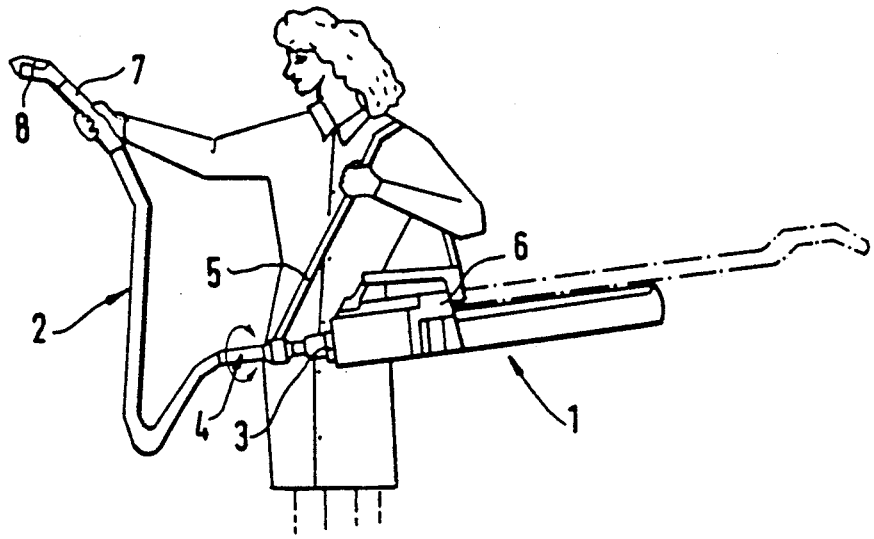
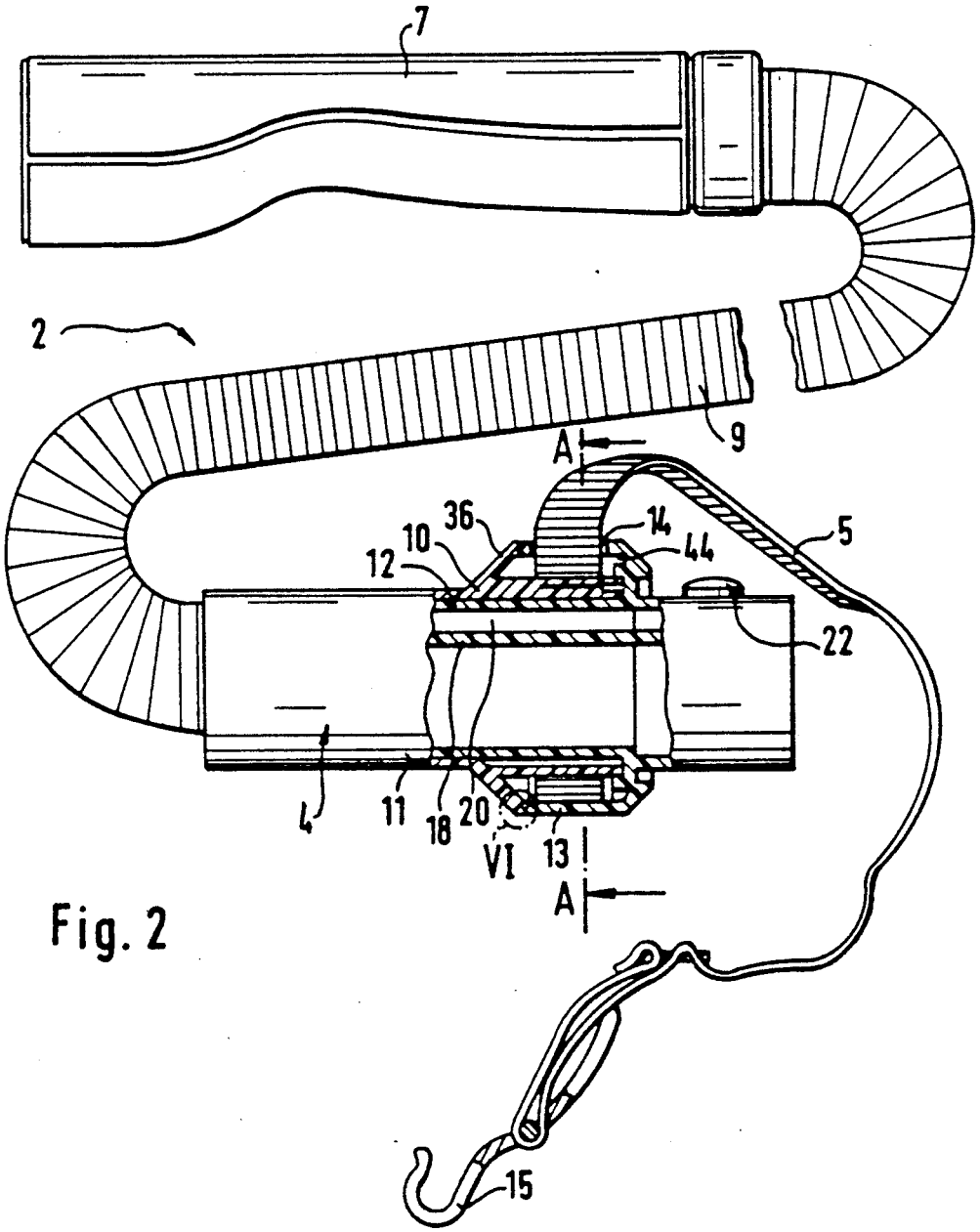
Fig. 2

CARRYING BELT ARRANGEMENT FOR A VACUUM CLEANER

BACKGROUND OF THE INVENTION

Carrying belts for vacuum cleaners are always then required when, for example, the user of a handheld vacuum cleaner or vacuum cleaner having a wand must perform work which requires that a vacuum hose be used. Since these vacuum cleaners are usually supported by a nozzle on the floor, the use of a vacuum hose makes it necessary to carry the vacuum cleaner in one hand and to manipulate the vacuum hose with the other hand. Since this is tiring, a carrying belt is utilized with the aid of which the vacuum cleaner is carried on the shoulder. In this way, the weight of the vacuum cleaner can be more easily carried and both hands are free for work.

A carrying belt of this kind is an accessory component which is not often utilized and for this reason can be easily misplaced so that it is not available when required. For this reason, the carrying belt is arranged on the vacuum cleaner so that it is always available when needed as shown, for example, in German utility model registration 82 24 611. In this arrangement, a carrier handle is provided on the motor head of the vacuum cleaner and is releasably connected with the motor head. This carrier handle has a grip part configured so as to be hollow and in which the carrier belt is arranged. A flap closes the grip part. When the flap is open, the carrying belt can be removed and after use, the belt is folded and placed in the grip part for storage and the flap is then closed.

Even though the grip part and the carrying belt are configured as a unit, the grip part is a separate part which is removed for vacuuming in the conventional manner. The vacuum hose and the carrying belt are utilized for all work which must be conducted at approximately hip height so that two separate parts are again required.

SUMMARY OF THE INVENTION

It is an object of the invention to provide a carrying belt arrangement wherein the two separate parts are combined so that the use of the carrying belt is simplified.

The carrying belt arrangement of the invention is for a vacuum cleaner having a motor housing and a vacuum hose. The carrying belt arrangement includes: a first part defining a longitudinal axis and having a first end connected to the vacuum hose and a second end attachable to the motor housing; a second part rotatably mounted on the first part so as to be rotatable about the longitudinal axis; the second part defining a drum; and, a carrying belt connected to the drum so as to unwind from the drum as the second part is rotated relative to the first part.

BRIEF DESCRIPTION OF THE DRAWINGS

The invention will now be described with reference to the drawings wherein:

FIG. 1 is a schematic representation of the carrying belt arrangement according to the invention shown together with a handheld vacuum cleaner during use;

FIG. 2 shows the carrying belt arrangement according to the invention connected to a vacuum hose wherein respective portions of the first and second parts of the carrying belt arrangement are broken away to show the carrying belt arranged in a storage compartment of the arrangement;

DESCRIPTION OF THE PREFERRED EMBODIMENTS OF THE INVENTION

Figure 3:
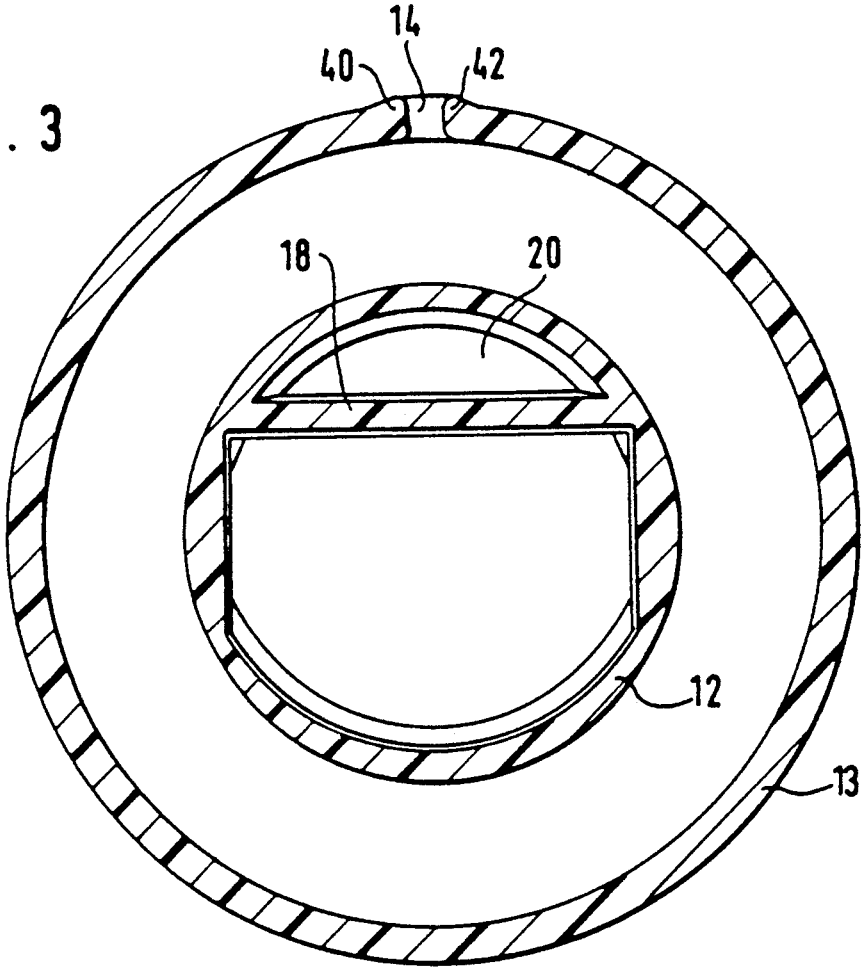
FIG. 3 is a section view taken along line A—A of FIG. 2 but showing only the first part of the carrying belt arrangement.

FIG. 1 is a schematic representation showing how a handheld vacuum cleaner with the wand removed is utilized for performing work which requires the use of a vacuum hose unit 2. For this purpose, the actual guide wand is removed and is mounted on the vacuum cleaner 1 as shown in phantom outline in FIG. 1. The carrying belt arrangement 4 of the invention is shown connected to a connecting tube stub 3 of the vacuum cleaner 1. A carrying belt 5 is disposed in the carrying belt arrangement 4 and is attached to the motor head 6. In this way, the vacuum cleaner 1 can be carried on the shoulder and work can be conducted with the aid of the vacuum hose unit 2 at locations above the floor such as at the elevation of the head of the operator and thereabove. A suction nozzle 8 is mounted on the hand grip 7 of the hose unit 2 for this purpose.

FIG. 2 provides a detailed view of the hose unit 2 and the carrying belt arrangement 4 of the invention. The hose unit 2 includes the hose 9 having the hand grip 7 at one end thereof and a rigid end piece 24 (see FIG. 5) at the other end thereof. The hose 9 includes a plurality of integral segments 26 which can bend relative to each other.

The hand grip 7 is provided for connecting to a suction nozzle and the end piece 24 latches into the left-hand end of a first part 12 of the carrying belt arrangement 4. Latching can, for example, be achieved with an annular shoulder 28 (FIG. 5) formed on the inner wall surface of the first part 12 which engages in an annular recess 30 formed in the end piece 24. The end piece 24 snaps into the first part 12 when inserted into the latter and firmly holds the hose 9 in the carrying belt arrangement 4.

On the other hand, the connection of end piece 24 to the first part 12 can be a fixed non-removable connection. For example, a suitable adhesive can be used to mount the end of the hose unit 2 in the first part 12.

The righthand end of the first part 12 attaches to a connecting stub 3 of the vacuum cleaner 1 with the aid of a detent represented schematically by the detent button 22 shown in FIG. 2.

The first part 12 includes a wall 18 which forms a separate compartment 20 for electric leads or the like and is unrelated to the invention per se.

Figure 5:
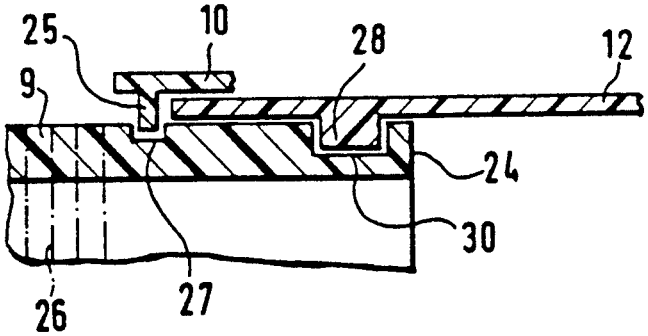
FIG. 5 is a broken away portion showing how the first part of the carrying arrangement is latched to the rigid end piece of a vacuum hose; and, FIG. 6 is an enlarged view of the detail VI shown in FIG. 2.

The carrying belt arrangement 4 includes a second part 10 which is mounted on the first part 12 so as to rotate relative thereto. The second part 10 is prevented from slipping down the hose 9 by holding means which, for example, can be an annular projection 25 formed on the second part 10 and slidably engaging a recess 27 formed in the rigid end piece 24 as shown in FIG. 5.

The first and second parts as well as the hose 9 and end piece 24 are all made of plastic.

As suggested above, the hose unit 2 can be permanently connected to the first part 12 with the second part 10 being rotatably mounted on the first part. The hose unit 2 and the carrying belt arrangement 4 then constitute a single accessory piece for use with the vacuum cleaner 1.

The carrying belt 5 is wound on a storage drum 32 formed on the second part 10. The second part 10 includes a sleeve-like extension 11 which extends from the drum 32 to the hose unit 2.

Figure 4:
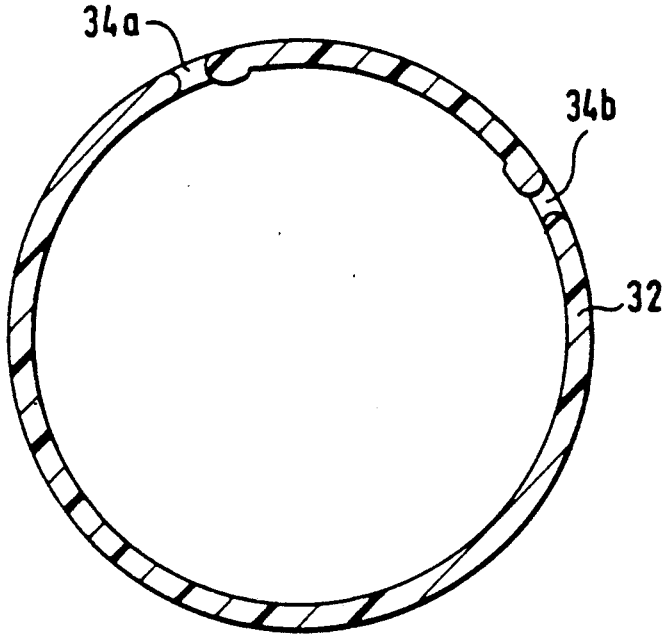
FIG. 4 is a section view also along line A—A of FIG. 2 but showing only the drum of the second part.

The outer surface of the second part 10 defines a hand grip which enables the operator to grasp the second part 10 and rotate the same on the first part 12 to wind the carrying belt 5 on the drum 32. The end of the carrying belt 5 is slipped into slits (34*a* and 34*b*) formed on the drum 32 where the belt is held so that it cannot become detached from the drum. The slits (34*a* and 34*b*) are shown in FIG. 4.

An annular cover 13 is formed on the first part 12 so as to extend over the drum 32 to form an annular storage compartment 44 for the belt 5. The cover 13 remains stationary as the second part 10 is rotated and includes a slot 14 (see FIG. 3) through which the belt 5 passes from the drum 32 as shown in FIG. 2. As belt 5 is pulled through the slot 14, the second part 10 rotates on the first part 12. The edges of the cover 13 defining the slot 14 are thickened at 40 and 42 to facilitate sliding of the belt 5 through the slot 14.

Figure 6:
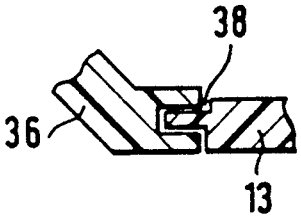

The cover 13 and an annular flange 36 formed on the second part 10 conjointly define a sliding annular interface at 38 (see FIG. 6) to close the compartment 44 in which the belt 5 is accommodated.

The belt 5 is provided at its outer end with a hook 15 for attachment to the motor head 6.

When the carrying belt 5 is no longer required, the operator grasps the second part 10 and rotates the same so that the belt is wound on the storage drum 32. In this way, the carrying belt 5 is always immediately available when an operator of the vacuum cleaner wishes to use the vacuum hose unit 2.

It is understood that the foregoing description is that of the preferred embodiments of the invention and that various changes and modifications may be made thereto without departing from the spirit and scope of the invention as defined in the appended claims.

What is claimed is:

1. A carrying belt arrangement for a vacuum cleaner having a motor housing and a vacuum hose, the carrying belt arrangement comprising:

a first part defining a longitudinal axis and having a first end connected to the vacuum hose and a second end attachable to the motor housing;

a second part rotatably mounted on said first part so as to be rotatable about said longitudinal axis;

said second part defining a drum; and, a carrying belt connected to said drum so as to unwind from said drum as said second part is rotated relative to said first part.

2. The carrying belt arrangement of claim 1, said first part being fixedly attached to the vacuum hose and said second part defining a hand grip.

3. The carrying belt arrangement of claim 2, said first part being a tubular member and forming a part of said hose; said second part having a tubular extension rotatably mounted on said tubular member; and, said second part having an outer surface defining a hand grip of the hose.

4. The carrying belt arrangement of claim 1, said first part having an annular cover formed thereon so as to extend over said drum; and, said cover and said drum conjointly defining an annular storage compartment for accommodating said belt therein.

5. The carrying belt arrangement of claim 4, said cover having a slot formed therein for passing said belt out of said storage compartment as said drum rotates relative to said cover.

6. The carrying belt arrangement of claim 1, said belt having an outer end and said belt including a hook at said outer end for hooking said belt to the motor housing.

* * * * *